US008523435B2

(12) United States Patent
Doue

(10) Patent No.: US 8,523,435 B2
(45) Date of Patent: Sep. 3, 2013

(54) PACKAGING BAG FOR NAPPIES, FOR EXAMPLE, AND PRODUCTION MACHINE AND METHOD

(75) Inventor: Philippe Doue, Compiegne (FR)

(73) Assignee: S2F Flexico, Henonville (FR)

( * ) Notice: Subject to any disclaimer, the term of this patent is extended or adjusted under 35 U.S.C. 154(b) by 895 days.

(21) Appl. No.: 10/581,440

(22) PCT Filed: Dec. 3, 2004

(86) PCT No.: PCT/FR2004/003112

§ 371 (c)(1),
(2), (4) Date: Mar. 16, 2007

(87) PCT Pub. No.: WO2005/056405

PCT Pub. Date: Jun. 23, 2005

(65) Prior Publication Data

US 2007/0297699 A1 Dec. 27, 2007

(30) Foreign Application Priority Data

Dec. 4, 2003 (FR) ..... 03 14276

(51) Int. Cl.
*B65D 30/00* (2006.01)
*B65D 33/16* (2006.01)
*B65D 33/30* (2006.01)

(52) U.S. Cl.
USPC ..... 383/2; 383/61.2; 383/63; 383/64; 383/66; 383/88; 383/89

(58) Field of Classification Search
USPC ..... 383/42, 2, 120, 66, 61.1, 88, 89, 383/61.2, 63, 64, 38, 34, 34.1, 95, 82, 83
See application file for complete search history.

(56) References Cited

U.S. PATENT DOCUMENTS

| | | | | |
|---|---|---|---|---|
| 4,332,344 | A * | 6/1982 | Strodthoff | 383/63 |
| 4,355,494 | A | 10/1982 | Tilman | |
| 4,953,708 | A * | 9/1990 | Beer et al. | 383/210.1 |
| 5,024,536 | A * | 6/1991 | Hill | 383/38 |
| 5,080,497 | A * | 1/1992 | Peppiatt | 383/21 |
| 5,150,824 | A * | 9/1992 | Alvarez et al. | 224/586 |
| 5,377,837 | A * | 1/1995 | Roussel | 206/494 |
| 6,325,543 | B1 | 12/2001 | Ausnit | |
| 6,481,183 | B1 * | 11/2002 | Schmidt | 53/412 |
| 6,939,281 | B2 * | 9/2005 | Bois | 493/213 |
| 7,182,512 | B2 * | 2/2007 | Bois | 383/5 |

(Continued)

FOREIGN PATENT DOCUMENTS

| | | | |
|---|---|---|---|
| EP | 0861771 | A1 * | 9/1998 |
| EP | 1 321 381 | A1 | 6/2003 |
| JP | 03240650 | A * | 10/1991 |
| JP | 03240651 | A * | 10/1991 |

*Primary Examiner* — Jes F Pascua

(74) *Attorney, Agent, or Firm* — Blakely Sokoloff Taylor & Zafman

(57) ABSTRACT

The invention relates to a packaging bag comprising at least one flap (24, 28) which is folded against one face of the bag body (10) and which is held in position by means of a removable linking element (30, 32). The invention is characterized in that the bag also comprises an element (50) which is designed to ensure that the bag can be opened and reclosed, which extends transversely to the fold line (22) of the flap and which covers the entire width of said flap (24, 28) and at least a substantial part of the bag body.

17 Claims, 3 Drawing Sheets

(56) References Cited

U.S. PATENT DOCUMENTS

2003/0053721 A1* 3/2003 Goldman ..... 383/38
2003/0185466 A1* 10/2003 Edelman et al. ..... 383/5
2004/0114838 A1* 6/2004 McGregor ..... 383/204

* cited by examiner

PACKAGING BAG FOR NAPPIES, FOR EXAMPLE, AND PRODUCTION MACHINE AND METHOD

BACKGROUND OF THE INVENTION

1. Field of the Invention

This present invention concerns the area of packaging bags. More precisely, this present invention concerns the area of packaging bags that include opening/closure resources that are capable of multiple successive openings and closures for example, and that take the form of complementary extrusions though not limited to these.

2. Description of Related Art

Document EP-A-1 321 381 illustrates one example of a known packaging bag, which is suitable for multiple successive openings and closures. This bag includes a flap which is folded back onto itself and held in this position by a detachable element, allowing single or multiple use as required. It also includes a second element to provide for re-closeable opening, placed at the end of the flap.

Though promising, the packaging bag described in document EP-A-1 321 381 had not experienced the commercial success expected.

BRIEF SUMMARY OF THE INVENTION

The objective of this present invention is to perfect the known bags. A particular objective of this present invention is to propose bags that are intended to receive contents that are packed under high pressure, such as baby nappies or equivalent, while still allowing easy access to the contents after removing a first article.

This objective is attained in the context of this present invention, by means of a packaging bag that includes at least one flap which is folded back against one face of the bag body, and held in this position by a detachable connecting element, characterised by the fact that it also includes an element designed to allow re-closeable opening, which lies across the fold line of the flap and covers the full width of the flap and at least a substantial part of the bag body.

On reading the following detailed description, the professional engineer will understand that the bag according to this present invention, in particular, by virtue of the specific arrangement of the element used to effect the re-closeable opening action, allows easy access to all the contents of the bag, while the bags of previous design as described in document EP-A-1 321 381 provide only limited access via the straight section of the flap.

According to another advantageous characteristic of this present invention, the element designed to provide for re-closeable opening covers all of the bag body.

According to another advantageous characteristic of this present invention, the bag includes two flaps folded against faces of the bag body that are diametrically opposite, and held in this position by respective detachable connecting elements.

According to another advantageous characteristic of the invention, the element designed to provide for re-closeable opening includes a closure element which is suitable for multiple openings and closures.

According to another advantageous characteristic of this present invention, the bag includes resources that prevent the closure element, which is suitable for multiple openings and closures, from being stressed by the contents of the bag when the said at least one flap is held folded back by the detachable connecting element.

This present invention also concerns a process for the creation of a bag, which includes stages designed to fit the flap of a bag, an element designed to provide for re-closeable opening which extends across the fold line of the flap and covers the full width of the flap and at least a substantial part of the bag body, to fold the flap formed in a bag body back onto itself and to hold the flap in this position by means of a detachable connecting element.

This present invention also concerns a device for the manufacture of bags that include resources suitable for fitting the flap of a bag, an element designed to provide for re-closeable opening, which lies across the fold line of the flap and covers the full width of the flap and at least a substantial part of the bag body, resources capable of folding back onto itself the flap formed in the bag body, and resources that are able to generate a detachable connection that is capable of holding the flap in this position.

BRIEF DESCRIPTION OF THE DRAWINGS

Other characteristics, aims and advantages of this present invention will appear on reading the detailed description that follows, with reference to the appended drawings, which are provided by way of non-limited examples and in which.

DETAILED DESCRIPTION OF THE INVENTION

Figure 1:
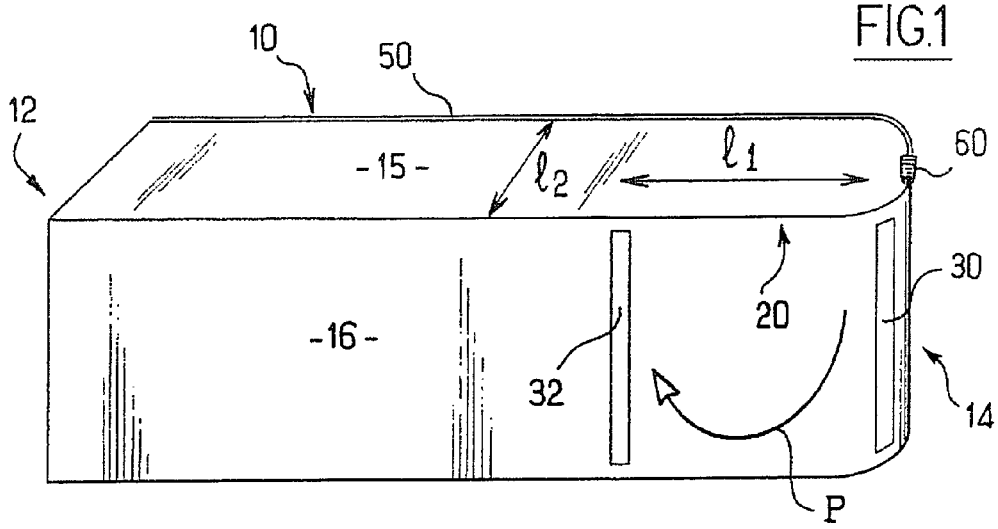
FIG. 1 schematically represents a view in perspective of a packaging bag according to this present invention before formation of the folded flap, FIG. 2 provides a schematic view in perspective of the same bag after folding of the flap, FIG. 3 schematically represents the same bag after opening of the re-closeable opening element to provide access to the contents of the bag.
Figure 2:
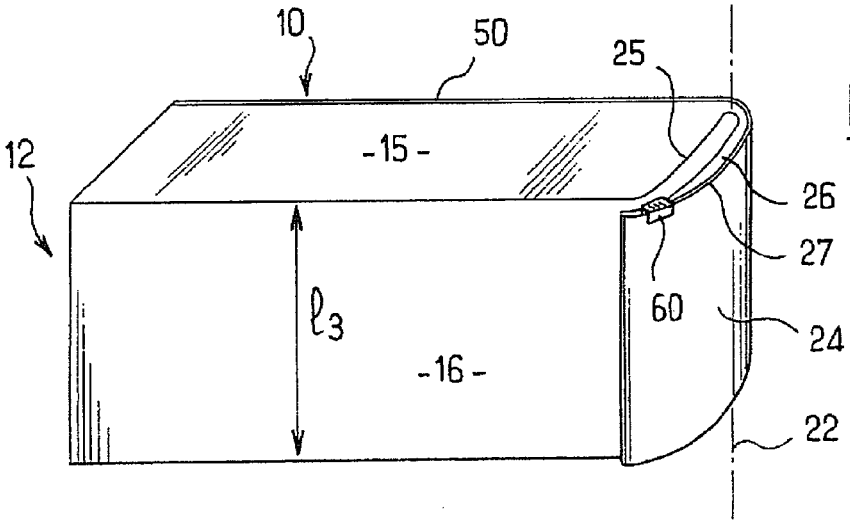

The attached FIGS. 1 and 2 show a bag according to the present invention, at two successive stages of its manufacture.

As shown in FIG. 1, originally the bag of this present invention includes a bag body 10 of generally tubular shape having a aperture for an opening 12 and a bottom 14 at the other end. Preferably, the bag body 10 is outlined by four main mutually-orthogonal walls. Its section is thus generally square or rectangular. Two of these walls are illustrated in FIG. 1 with the references 15 and 16. The two additional walls are respectively parallel and perpendicular to each of these two walls 15 and 16.

The walls of the bag can be the subject of many methods of implementation.

The walls are preferably made from a thermoplastic material.

These walls can be mono or multi-layer, and mono or multi-material. Where appropriate, it can concern a paper base covered with a layer of thermoplastic material, or again with a metallised thermoplastic layer.

The bag 10 can be created from a single sheet or several sheets, such as two sheets welded together at their edges, preferably along one of the edges connecting the main walls, such as the edge common to walls 15 and 16.

As mentioned previously, in the context of this present invention, one part 20 of the bag body 10, here adjacent to the bottom 14, is folded back onto itself in the form of a flap. The part 20 of the bag 10 folded in the form of a flap has a length 11 that is more or less equal to twice the width 12 of the bag. The aforementioned lengths 11 and width 12 of the bag are assumed to be perpendicular to the fold line 22 of the flap.

The aforementioned folding operation is indicated by an arrow, referenced P, in FIG. 1. The flap thus obtained from the bottom 14 is referenced 24 in FIG. 2.

As can be seen in FIG. 2, the flap 24 thus preferably covers the whole section of the bag so that after creation of the flap 24 at the bottom, the bag 10 has a triple thickness in the form of layers referenced 25, 26 and 27 in FIG. 2.

The flap 24 is held in this position by a detachable connecting element. The latter can be the subject of many implementation variants.

According to a first method of implementation, the aforementioned detachable connecting element can be formed from a self-adhesive strip. Such an self-adhesive strip can be provided on the end of the bag and on the flap, in the form of the strip referenced 30 in FIG. 1, or again on one of the walls 16 of the bag, intended to receive the end of the flap, in the form of the strip referenced 32 in FIG. 1, or again of two complementary self-adhesive strips corresponding to the two strips 30 and 32 shown in FIG. 1. (These two strips 30 and 32 being brought into contact during the folding of the flap 24).

The aforementioned strips 30 and/or 32 lie parallel to the fold line 22 of the flap, more or less over the full height 13 of the bag, with the said height 13 being assumed to be parallel to the fold line 22.

According to another implementation variant, the detachable connection resource can be formed from complementary elements located respectively at the aforementioned strips 30 and 32 shown in FIG. 1, that is one on the end of the bag coincident with the end of the flap 24 and the other at a wall 16 of the bag body intended to receive the end of the aforementioned flap 24.

By way of a non-limited example, such complementary elements can be formed from complementary structures of the "VELCRO" type (e.g. hook and loop structures) or again from complementary male/female extrusions, or even from complementary hooked structures (possibly operated by a slide).

Such connection elements are well known to the professional engineer and will therefore not be described in detail in what follows.

In the context of this present invention, the bag also includes at least one closure element, which is suitable for multiple openings and closures. Such a closure assembly is referenced 50 in the attached figures.

As has been indicated previously, in the context of this present invention, this element 50 designed to provide for re-closeable opening, extends across the fold line 22 of the flap and covers the full width of the flap and at least a substantial part of the bag body. It thus provides easy access to all the contents of the bag.

Preferably, the bag includes resources that prevent the closure element 50 from being stressed by the contents of the bag when the flap is held folded back by a connection element 30, 32.

By way of a non-limited example, the closure assembly 50 is preferably provided on one edge of a flap, across the fold line 22.

The closure assembly 50 can itself be the subject of many variants, it can be a self-stick element, complementary elements of the "VELCRO" type (e.g. hook and loop structures), complementary elements of the male/female type, or again complementary elements of the hooked type.

Figure 6:
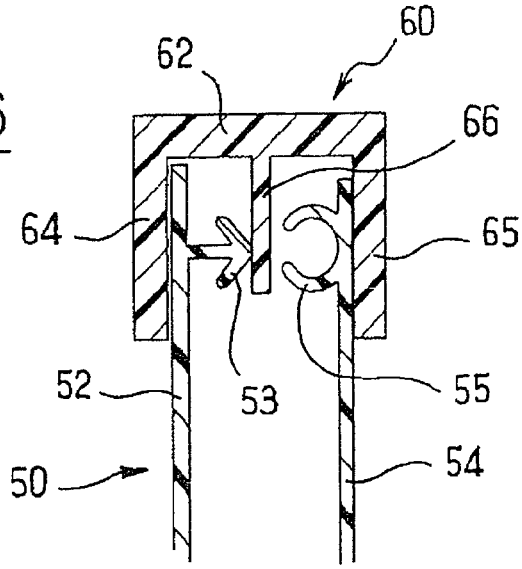
FIG. 6 represents a view in cross-section of a closure assembly according to this present invention, equipped with a slide.

Attached FIG. 6 shows an advantageous variant of this present invention in which the closure element 50 is thus formed from two complementary extrusions 52, 54 that respectively include an element 53 of the male type and a complementary element 55 of the female type.

All of these resources are well known to the professional engineer. They will therefore not be described in detail in what follows.

Where appropriate, these opening/closure resources making up element 50 can be operated by a slide 60.

Such a slide has been shown in diagrammatic form in the attached FIG. 6. Here again, it can be the subject of many methods of implementation.

Such a slide 60 preferably includes a base 62 which carries two lateral cheeks 64, 65 and a low central wall 66 forming between them two non-parallel channels 67, 68 respectively accommodating at least the top of one of the two support webs 52, 54 of the said at least one closure element 50 so that, depending on the direction of movement of the slide 60, the latter forces the element 50 to open or to close respectively. Where appropriate, though this arrangement is not imperative, the low central wall 66 can enter between the complementary extrusions 53, 55.

Once the flap 24 located at the bottom 14, folded back and held by the associated connection resources 30 and 32, the bag 10 can be filled under pressure in a conventional manner via the aperture 12 and then closed off at the aperture 12 by any appropriate conventional means.

Figure 3:
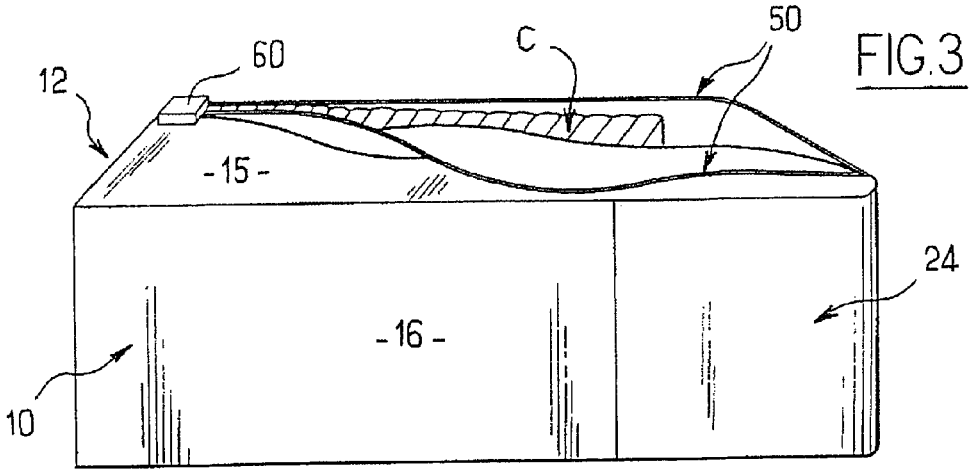

In use, in order to provide access to the contents of the bag, it is necessary only to break the connection element 30, 32, in order to deploy the flap 24. The bag then returns to a geometry that is close to that illustrated in FIG. 1. It is then possible to open the element 50, as illustrated in FIG. 3, to gain easy access to the contents C of the bag, a set of baby nappies for example, even though the latter have been packed under pressure in an originally sealed bag 10.

In particular, this present invention can be applied in order to facilitate access to baby nappies, for example.

Figure 4:
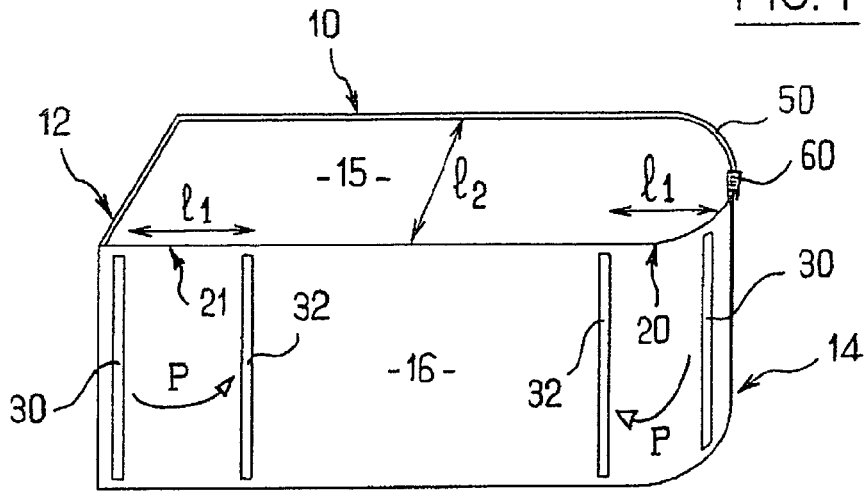
FIGS. 4 and 5 represent views that are respectively similar to those of the aforementioned FIGS. 1 and 2, before and after closure, of a bag according to one implementation variant of this present invention, which includes two flaps folded on diametrically opposite faces of the bag.
Figure 5:
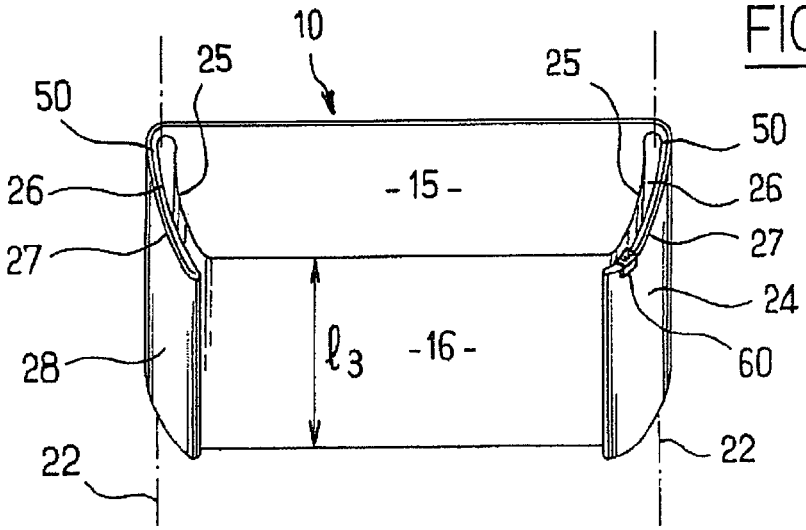

FIGS. 4 and 5 show an implementation variant in which the bag has two flaps 24 and 28 folded on diametrically opposite faces of the bag, namely respectively a bottom part 20 and the mouth aperture part 21. Of course it is necessary in this case to provide retention resources 30, 32, similar to those previously described, associated with the flap 28 formed on the aperture.

This present invention also has the advantage of stiffening the ends of the bags or containers 10, in particular at the bottom. In fact as can be seen in FIGS. 2 and 5, the bottom of the bag has three thicknesses 25, 26, 27. This also applies to the aperture, in the event that the bag has two flaps. This is extremely useful for positioning on a shelf at the point of sale.

Of course this present invention is not limited to the particular methods of implementation have just been be described, but extends to any variant that complies with its spirit.

Figure 7:
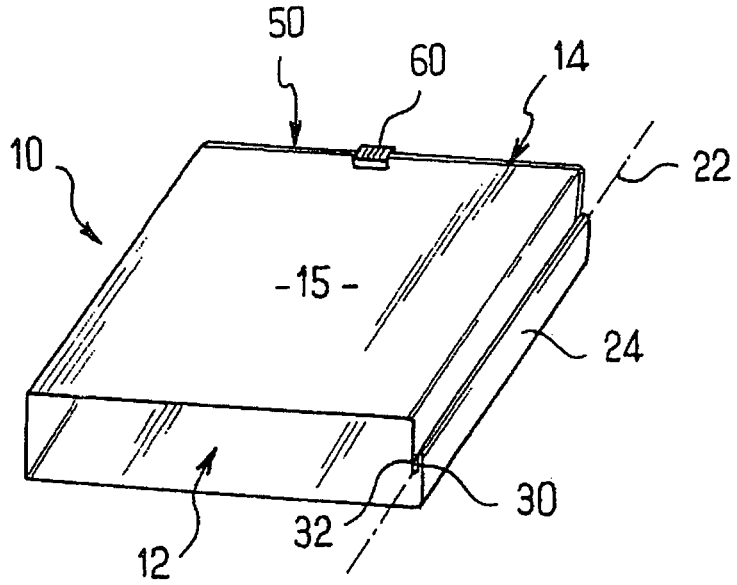
FIGS. 7 and 8 show other variants according to this present invention.

During the closure of the bag, the slide (60 can be placed on the flap as illustrated in FIGS. 2 and 5, or away from the flap, as illustrated in FIG. 7.

In the context of this present invention, the detachable connection resources 30, 32, and the closure element 50 can be made from the material of the film comprising the wall of the bag, during the manufacture of this film, or again can be formed initially from separate elements that are attached, by welding for example, onto the film making up the bag.

According to the methods of implementation previously described, the flaps 24 and 28, respectively provided at the bottom 14 and the aperture 12, lie in a plane that is generally perpendicular to the direction of introduction of the contents into the bag 10 via the aperture 12.

Figure 8:
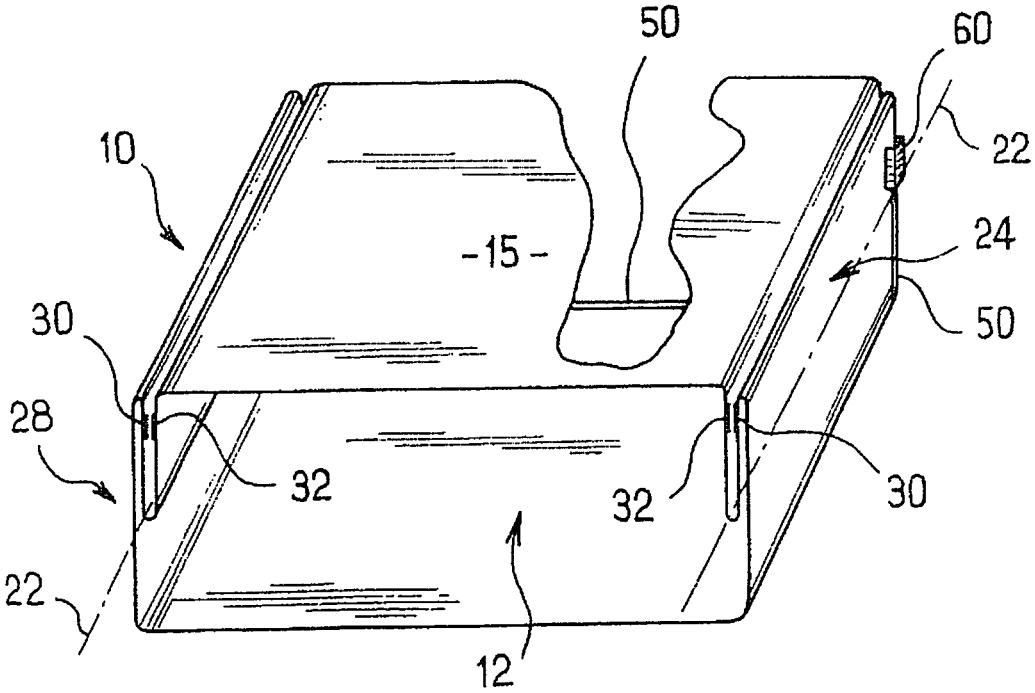

On the other hand, according to the variants illustrated in FIGS. 7 and 8, the flaps 24 and 28 lie in a plane that is generally parallel to the direction of introduction of the contents into the bag 10 via the aperture 12. To this end, according to FIGS. 7 and 8, the flaps 24 and 28 are folded onto themselves against one of the faces surrounding the opening aperture 12.

As can be seen in FIG. 7, according to a variant of the invention, each flap 24 or 28 can cover only part of the area of the wall of the bag body 10 against which the said flaps 24 and 28 are folded. This variant in which the flaps 24 and 28 cover only part of the section of the bag can apply any of the methods of implementation of the invention.

The invention claimed is:

1. A packaging bag that includes at least one flap formed at one end of a bag body, said flap being folded back along a fold line against a face of the bag body and held in this position by a detachable connecting element that includes a strip parallel to the fold line of the flap on the part of the bag body receiving an end of the flap, wherein said packaging bag also includes an element designed to provide for a re-closeable opening which extends perpendicularly to the fold line and covers the full length of the flap and at least a substantial length of a bag body section which lies under the fold line, wherein said element designed to provide for a re-closeable opening provides access to all the contents of the bag, and wherein the bag includes two flaps folded against diametrically opposite faces of the bag body and held in this position by detachable connecting elements respectively.

2. A bag according to claim 1, characterised by the fact that the element designed to provide for re-closeable opening covers the whole of the bag body.

3. A bag according to claim 1, characterised by the fact that the element designed to make possible re-closeable opening, includes a closure element which is suitable for multiple openings and closures.

4. A bag according to claim 1, characterised by the fact that the detachable connecting element includes at least one self-adhesive strip.

5. A bag according to claim 1, characterised by the fact that the detachable connecting element includes hook and loop complementary elements.

6. A bag according to claim 1, characterised by the fact that the detachable connecting element includes two extrusions that have complementary male/female or hooked extrusions.

7. A bag according to claim 1, characterised by the fact that the element designed to provide for a re-closeable opening includes a self-stick element.

8. A bag according to claim 1, characterised by the fact that the element designed to provide for a re-closeable opening includes a hook and loop element.

9. A bag according to claim 1, characterised by the fact that the element designed to provide for a re-closeable opening includes two complementary male, female or hooked extrusions.

10. A bag according to claim 9, characterised by the fact that the closure element comprises a slide.

11. A bag according to claim 1, characterised by the fact that the detachable connecting element includes a strip located on the end of the flap, parallel to the fold line of the flap and more or less over the full height of the bag.

12. A bag according to claim 1, characterised by the fact that the detachable connecting element includes a strip parallel to the fold line of the flap, on the part (16) of the bag body receiving the end of the flap.

13. A bag according to claim 1, characterised by the fact that the detachable connecting element includes two strips parallel to the fold line of the flap provided respectively on the end of the flap and on the wall of the bag body intended to receive this end.

14. A bag according to claim 1, characterised by the fact that the flap extends in a plane that is generally perpendicular to the direction of introduction of the contents into the bag.

15. A bag according to claim 1, characterised by the fact that each flap extends in a plane that is generally parallel to the direction of introduction of the contents into the bag, against a wall of the latter which surrounds an original aperture (12).

16. A bag according to claim 1, characterised by the fact that each flap covers part of the face of the bag body against which it is folded back.

17. A packaging bag that includes at least one flap formed at one end of a bag body, said flap being folded back along a fold line against a face of the bag body and held in this position by a detachable connecting element that includes a strip parallel to the fold line of the flap on the part of the bag body receiving an end of the flap, wherein said packaging bag also includes an element designed to provide for a re-closeable opening which extends perpendicularly to the fold line and covers the full length of the flap and at least a substantial length of a bag body section which lies under the fold line, wherein said element designed to provide for a re-closeable opening provides access to all the contents of the bag, and wherein the bag includes two flaps folded against the faces of the bag body that are diametrically opposite and located around an original aperture.

* * * * *